US010955173B2

(12) United States Patent
Nagashima

(10) Patent No.: US 10,955,173 B2
(45) Date of Patent: Mar. 23, 2021

(54) REFRIGERATION APPARATUS

(71) Applicant: DAIKIN INDUSTRIES, LTD., Osaka (JP)

(72) Inventor: Toshihiro Nagashima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 66 days.

(21) Appl. No.: 16/336,409

(22) PCT Filed: Aug. 24, 2017

(86) PCT No.: PCT/JP2017/030392
§ 371 (c)(1),
(2) Date: Mar. 25, 2019

(87) PCT Pub. No.: WO2018/061548
PCT Pub. Date: Apr. 5, 2018

(65) Prior Publication Data

US 2019/0219309 A1 Jul. 18, 2019

(30) Foreign Application Priority Data

Sep. 30, 2016 (JP) ..... JP2016-193031

(51) Int. Cl.
*F25B 1/00* (2006.01)
*F24F 1/16* (2011.01)
(Continued)

(52) U.S. Cl.
CPC ..... *F25B 1/005* (2013.01); *F24F 1/16* (2013.01); *F25B 1/00* (2013.01); *F25B 5/02* (2013.01);
(Continued)

(58) Field of Classification Search
CPC .... F25B 1/005; F25B 1/00; F25B 5/02; F25B 6/02; F25B 13/00; F25B 25/005;
(Continued)

(56) References Cited

U.S. PATENT DOCUMENTS

2010/0226104 A1* 9/2010 Takeichi ..... F24F 1/22 361/752
2012/0125033 A1 5/2012 Tanno et al.
(Continued)

FOREIGN PATENT DOCUMENTS

CN 1508488 A 6/2004
JP 56-144267 U 10/1981
(Continued)

OTHER PUBLICATIONS

International Search Report (PCT/ISA/210) issued in PCT/JP2017/030392, dated Nov. 21, 2017.

*Primary Examiner* — Joseph F Trpisovsky
(74) *Attorney, Agent, or Firm* — Birch, Stewart. Kolasch & Birch, LLP

(57) ABSTRACT

A heat exchange section includes a first air heat exchanger having three vertical side surfaces through which air passes, the three side surfaces being arranged in a substantially U shape when viewed in plan, and a second air heat exchanger which is formed in a substantially flat plate shape, arranged obliquely to be away from an open surface of the first air heat exchanger toward a top end thereof, and has a single sloping surface through which the air passes.

9 Claims, 8 Drawing Sheets

(51) Int. Cl.
*F25B 5/02* (2006.01)
*F24F 110/40* (2018.01)
*F24F 110/10* (2018.01)

(52) U.S. Cl.
CPC ..... *F24F 2110/10* (2018.01); *F24F 2110/40* (2018.01)

(58) Field of Classification Search
CPC ..... F25B 40/02; F25B 2313/003; F25B 2313/004; F25B 2341/064; F25B 2700/21175; F25B 2700/1933; F24F 1/16; F24F 1/46; F24F 1/48; F24F 1/50; F24F 13/32; F24F 2110/10; F24F 2110/40
See application file for complete search history.

(56) References Cited

U.S. PATENT DOCUMENTS

| | | | |
|---|---|---|---|
| 2013/0081417 | A1 | 4/2013 | Tamura et al. |
| 2013/0333409 | A1 | 12/2013 | Tanno et al. |

FOREIGN PATENT DOCUMENTS

| | | | |
|---|---|---|---|
| JP | 2003-254565 | A | 9/2003 |
| JP | 2008-292068 | A | 12/2008 |
| JP | 2013-83429 | A | 5/2013 |
| JP | 2013-160445 | A | 8/2013 |
| KR | 10-1423102 | B1 | 7/2014 |
| WO | WO 2011/013672 | A1 | 2/2011 |
| WO | WO 2011/099629 | A1 | 8/2011 |
| WO | WO 2013/118381 | A1 | 8/2013 |
| WO | WO 2016/091021 | A1 | 6/2016 |

* cited by examiner

REFRIGERATION APPARATUS

TECHNICAL FIELD

The present invention relates to a refrigeration apparatus.

BACKGROUND ART

A refrigeration apparatus such as an air conditioner has been known.

For example, Patent Document 1 discloses a refrigeration apparatus including a pair of air heat exchangers, and a support on which the pair of air heat exchangers is placed. Each of the air heat exchangers has three side surfaces that are arranged substantially in a U shape when viewed in plan. As illustrated in FIGS. 3 and 4 of Patent Document 1, the two air heat exchangers are arranged such that their open surfaces face each other. The two air heat exchangers respectively have center side surfaces which are inclined so that their outer faces are oriented obliquely downward. That is, the two air heat exchangers are arranged substantially in the shape of V when viewed from the side.

CITATION LIST

Patent Documents

[Patent Document 1] International Publication No. WO2011/013672

SUMMARY OF THE INVENTION

Technical Problem

In a configuration in which two air heat exchangers are arranged upright in the shape of V as described in Patent Document 1, the lower ends of the side surfaces of the air heat exchangers other than the center side surfaces are close to each other and easily interfere with each other. According to Patent Document 1, in order to prevent such interference, the width of the side surfaces other than the center side surfaces is made relatively small. Specifically, this configuration increases the area of a portion that does not contribute to the heat exchange and is formed between the two air heat exchangers (e.g., a shielding plate 15 in the isosceles triangular shape shown in FIG. 3 of Patent Document 1). As a result, the total heat transfer area of the air heat exchangers decreases, which leads to a decrease in the capacity of a heat source unit.

In view of the foregoing, it is an object of the present invention to provide a refrigeration apparatus which can enlarge the total heat transfer area of an air heat exchanger.

Solution to the Problem

A first aspect of the present invention is directed to an air conditioner including: An air conditioner comprising: a heat exchange section (48) allowing a refrigerant and air to exchange heat; a fan (17) transporting the air passing, through the heat exchange section (48); and a support (70) supporting the heat exchange section (48) from below. The heat exchange section (48) includes a first air heat exchanger (50) having three vertical side surfaces (51, 52, 53) through which the air passes, the three side surfaces (51, 52, 53) being arranged in a substantially U shape when viewed in plan, and a second air heat exchanger (60) which is formed in a substantially flat plate shape, arranged obliquely to be away from an open surface (54) of the first air heat exchanger (50) toward a top end thereof, and has a single sloping surface (61) through which the air passes.

In the first aspect, the first air heat exchanger (50) having the three side surfaces (51, 52, 53) is placed upright, and the second air heat exchanger (60) which is formed substantially in a flat plate shape and has the sloping surface (61) is arranged obliquely. With the second air heat exchanger (60) arranged obliquely, the area of the sloping surface (61) increases as compared with the case where the second air heat exchanger is placed upright. Further, when the pair of side surfaces (51, 52) of the first air heat exchanger (50) extends to the vicinity of the second air heat exchanger (60), the area of the side surfaces (51, 52) can relatively increase. Specifically, in the present invention, a portion that does not contribute to heat exchange and is formed between the two air heat exchangers (50, 60) is substantially in the shape of a right-angled triangle, so that the area of the portion can be reduced as compared with a prior art example (i.e., a portion that does not contribute to heat exchange is in the shape of an isosceles triangle). Thus, the present invention can increase the total heat transfer area of the air heat exchangers (50, 60).

A second aspect of the present invention is an embodiment of the first aspect. In the second aspect, machine chambers (S1, S2, S3, S4) are formed in the support (70), and the second air heat exchanger (60) is inclined so as to overhang outward from a side surface (77) of the support (70).

In the second aspect, the machine chambers (S1, S2, S3, S4) are formed in the support (70). Thus, a plurality of components can be installed in the support (70). The second air heat exchanger (60) is inclined so as to overhang outward from the side surface (77) of the support (70). This can ensure a maintenance space below the second air heat exchanger (60). A worker can make access to the machine chambers (S1, S2, S3, S4) in the support (70) through the maintenance space.

A third aspect of the present invention is an embodiment of the second aspect. In the third aspect, a leg (79) protruding in a direction in which the second air heat exchanger (60) overhangs is provided at a bottom of the support (70).

In the third aspect, the leg (79) is provided at the bottom of the support (70). Since the second air heat exchanger (60) overhanging outward is provided on the support (70), the refrigeration apparatus (1) may fall down in the direction in which the second air heat exchanger (60) overhangs. However, the leg (79) of the support (70) extending in the direction in which the second air heat exchanger (60) overhangs can avoid the fall of the refrigeration apparatus (1) with reliability.

A fourth aspect of the present invention is an embodiment of any one of the first to third aspects. In the fourth aspect, a refrigerant circuit (10) in which the first air heat exchanger (50), the second air heat exchanger (60), a first expansion valve (13), and a second expansion valve (14) are connected in parallel, the first and second expansion valves (13, 14) respectively corresponding to the first and second air heat exchangers (50, 60), wherein In an operation in which the first and second air heat exchangers (50, 60) serve as evaporators, opening degrees of the first and second expansion valves (13, 14) are individually controlled so that an index indicating a degree of superheat of the refrigerant flowing out of the first air heat exchanger (50) approaches a target value, and an index indicating a degree of superheat of the refrigerant flowing out of the second air heat exchanger (60) approaches a target value.

In the fourth aspect, the first expansion valve (13) and the second expansion valve (14) are respectively connected in parallel with the first air heat exchanger (50) and the second air heat exchanger (60) in the refrigerant circuit (10). In an operation in which the air heat exchangers (50, 60) serve as evaporators, the opening degrees of the expansion valves (13, 14) are regulated so that an index indicating a degree of superheat of the refrigerant flowing out of each of the air heat exchangers (50, 60) approaches a target value. Thus, in each of the air heat exchangers (50, 60), the entire heat transfer surface can be used for the evaporation of the refrigerant. Further, this can reliably avoid the compressor (12) from sucking a liquid refrigerant.

A fifth aspect of the present invention is an embodiment of any one of the first to fourth aspects. In the fifth aspect, at least one of a pair of side surfaces (51, 52) of the first air heat exchanger (50) facing each other is inclined outward to form an obtuse angle with a center side surface (53).

In the fifth aspect, at least one of the side surfaces (51, 52) facing each other is arranged obliquely to be away from the other toward its lateral end. This can further increase the heat transfer area of the side surfaces (51, 52, 53).

A sixth aspect of the present invention is an embodiment of the fifth aspect. In the sixth aspect, the heat exchange section (48) includes a plurality of heat exchange sections (48), the plurality of heat exchange sections (48) are arranged adjacent to each other such that the center side surfaces (51, 52, 53) of the first air heat exchangers (50) are aligned in a horizontal direction, both of the pair of side surfaces (51, 52) are inclined outward so as to form an obtuse angle with the center side surface (53), and a space (55) which is widened toward the center side surface (53) is formed between the two side surfaces (51, 52) adjacent to each other.

In the sixth aspect, when two or more first air heat exchangers (50) are arranged adjacent to each other, a space (55) is formed between the side surfaces (51, 52) adjacent to each other. This space (55) is widened toward the center side surface (53). Therefore, the air outside the first air heat exchanger (50) easily enters toward the ends of the two side surfaces (51, 52) (deep inside the first heat exchanger) via this space. This allows the air to easily pass through the whole part of the two side surfaces (51, 52), thereby sufficiently ensuring a substantial heat transfer area of the first air heat exchanger (50).

Advantages of the Invention

According to the first aspect of the invention, a combination of the upright first air heat exchanger (50) having the three side surfaces (51, 52, 53) and the obliquely arranged second air heat exchanger (60) substantially in the planar shape can reduce the area of a portion that does not contribute to the heat exchange and is formed between the two air heat exchangers (50, 60). This can provide the second air heat exchanger (60) with a sufficient heat transfer area. As a result, the total heat transfer area of the heat exchange section (48) with respect to the installation space can be enlarged. Further, since the second air heat exchanger (60) is in the shape of a flat plate with no bend, the manufacturing cost of the second air heat exchanger (60) can be reduced.

According to the second aspect of the invention, the maintenance space can be ensured below the second air heat exchanger (60), through which access to the machine chambers (S1, S2, S3, S4) is allowed. Even in the case where a plurality of refrigeration apparatuses (1) are arranged side by side, a maintenance space between two adjacent refrigeration apparatuses can be ensured.

According to the third aspect of the invention, the fall of the refrigeration apparatus (1) can be avoided with reliability.

According to the fourth aspect of the invention, the refrigerant can be reliably evaporated in each of the two air heat exchangers (50, 60), which can ensure the performance of each of the air heat exchangers (50, 60). This can reliably avoid the compressor (12) from sucking a liquid refrigerant.

According to the fifth aspect of the invention, the heat transfer area of the pair of side surfaces (51, 52) of the first air heat exchanger (50) can be further increased.

According to the sixth aspect of the present invention, the air can be reliably introduced into the space (55) between the two adjacent side surfaces (51, 52), and the substantial heat transfer area of the side surfaces (51, 52) can be enlarged.

DESCRIPTION OF EMBODIMENTS

An embodiment of the present invention will be described in detail below with reference to the drawings. The embodiment described below is merely an exemplary one in nature, and is not intended to limit the scope, applications, or use of the invention.

Embodiment of Invention

Figure 1:
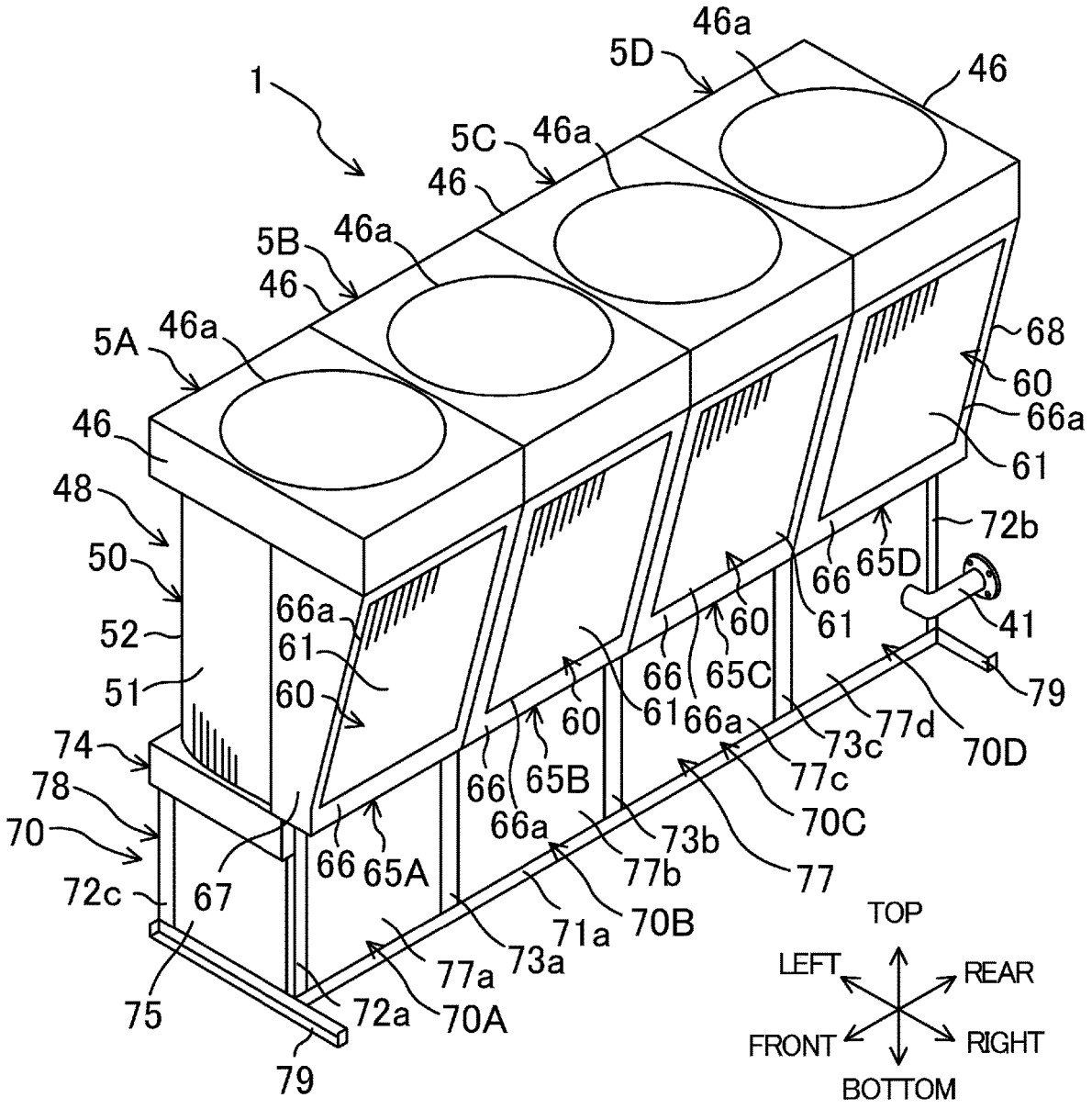
FIG. 1 is a general perspective view illustrating front and right sides of a chiller apparatus.
Figure 2:
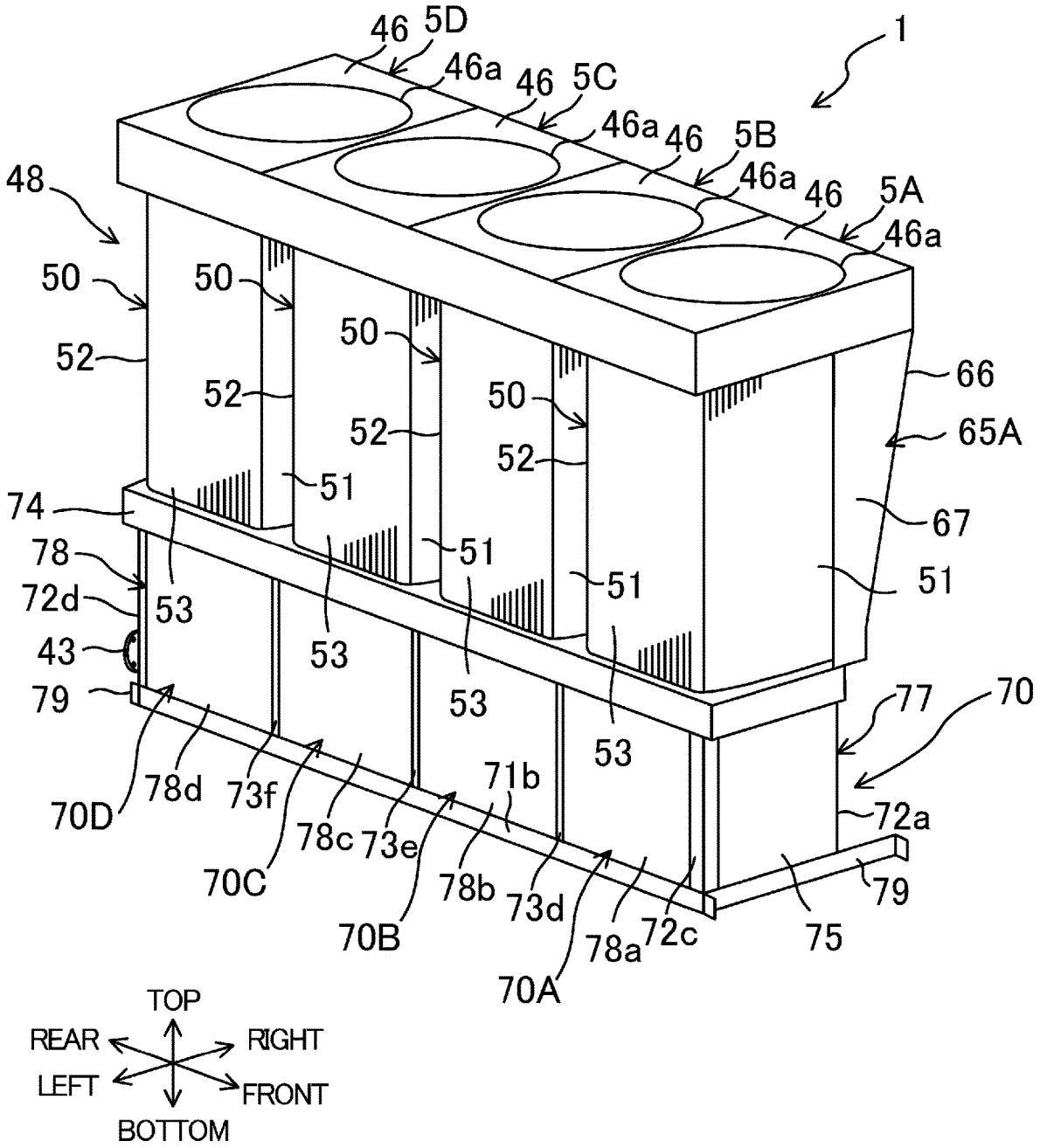
FIG. 2 is a general perspective view illustrating front and left sides of the chiller apparatus.

A refrigeration apparatus of the present invention is a cold/hot water chiller apparatus (1) which cools and heats water with a refrigerant. As shown in FIGS. 1 and 2, the chiller apparatus (1) includes, for example, four heat source units (5A, 5B, 5C, 5D) arranged in a row.

—Piping System of Chiller Apparatus—

Figure 3:
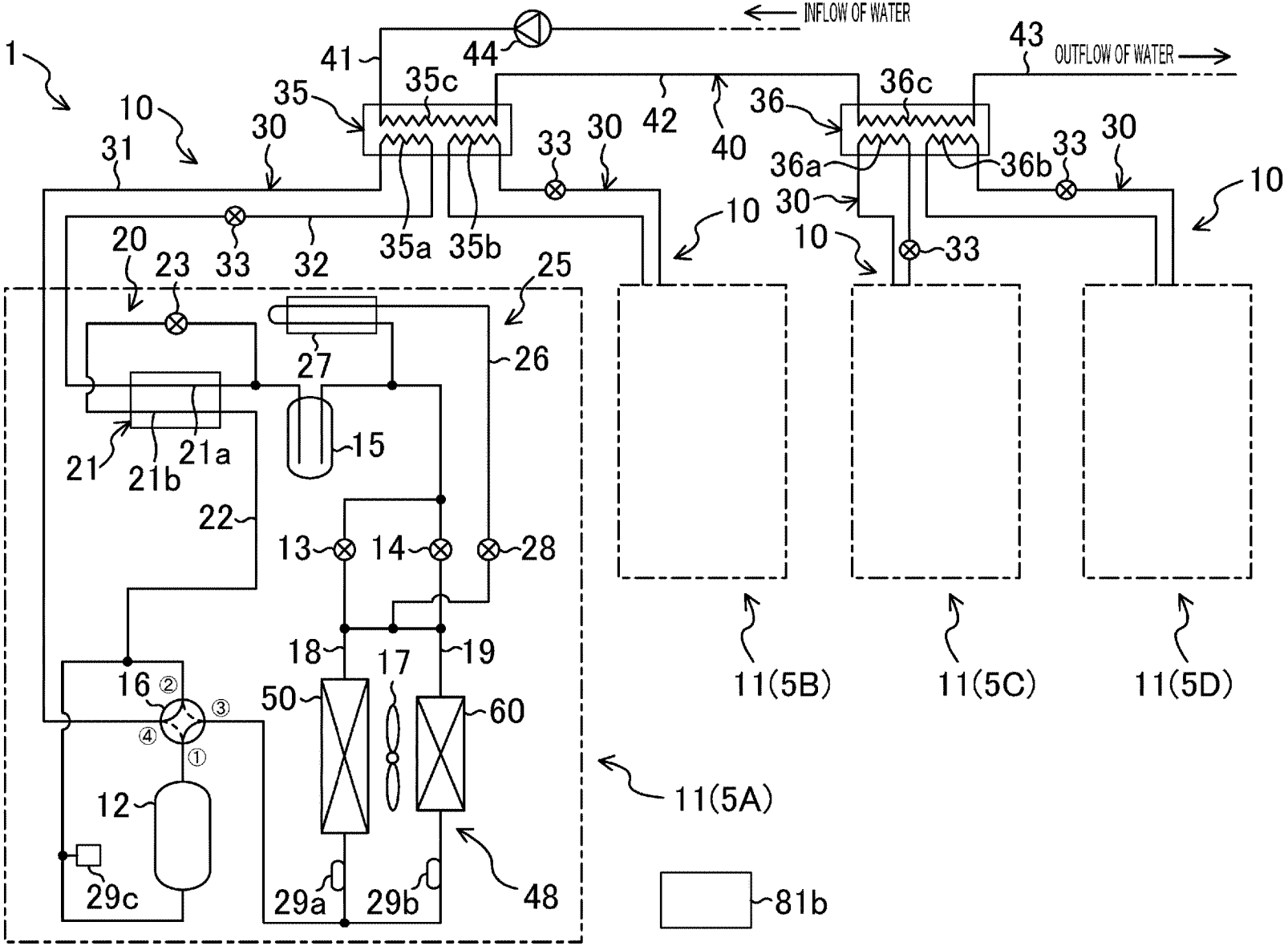
FIG. 3 is a piping diagram of the chiller apparatus.

A piping system of the chiller apparatus (1) will be described with reference to FIG. 3. The chiller apparatus (1) has four refrigerant circuits (10), a single water circuit (40), and two water heat exchangers (35, 36) connected to the refrigerant circuits (10) and the water circuit (40). In each of the refrigerant circuits (10), a refrigerant is circulated to perform a vapor compression refrigeration cycle. Water is supplied from a predetermined water supply source into the water circuit (40). After being heated or cooled in the water circuit (40), water is supplied to a predetermined target of temperature regulation. Note that the number of the refrigerant circuits (10), the number of the water heat exchangers (35, 36), and the number of the water circuit (40) are merely examples, and may be any number.

<Refrigerant Circuit>

Each of the refrigerant circuits (10) includes a heat source circuit (11) and a utilization circuit (30) connected together. The four heat source circuits (11) respectively correspond to the four heat source units (5A, 5B, 5C, 5D). The heat source circuits (11) and the utilization circuits (30) are configured basically in the same manner. Thus, FIG. 3 shows the detailed configuration of the heat source circuit (11) of the first heat source unit (5A), and the detailed configuration of the heat source circuits (11) of the other heat source units (5B, 5C, 5D) are omitted.

[Heat Source Circuit]

The heat source circuits (11) are respectively provided for the corresponding heat source units (5A, 5B, 5C, 5D). A compressor (12), a first air heat exchanger (50), a second air heat exchanger (60), a first expansion valve (13), a second expansion valve (14), a receiver (15), and a four-way switching valve (16) are connected to each heat source circuit (11).

The compressor (12) sucks and compresses a refrigerant, and discharges the compressed refrigerant. The first air heat exchanger (50) and the second air heat exchanger (60) are fin-and-tube heat exchangers. In each of the air heat exchangers (50, 60), the air transported by the fan (17) and the refrigerant exchanges heat. Each of the first expansion valve (13) and the second expansion valve (14) is a motor-operated valve whose opening degree is variable. The first air heat exchanger (50) and the second air heat exchanger (60) adjacent to each other constitute a heat exchange section (48) in which the refrigerant and the air exchange heat.

The first air heat exchanger (50) and the first expansion valve (13) are connected to a first parallel circuit (18), and the second air heat exchanger (60) and the second expansion valve (14) are connected to a second parallel circuit (19). The first parallel circuit (18) and the second parallel circuit (19) are parallel refrigerant circuits which are parallel with each other.

The receiver (15) is a hollow, vertically elongated hermetic container, and constitutes a refrigerant regulator. A surplus of the refrigerant is stored in the receiver (15).

The four-way switching valve (16) has first to fourth ports. In the four-way switching valve (16), the first port is connected to a discharge portion of the compressor (12), the second port is connected to a suction portion of the compressor (12), the third port is connected to a gas-side end of each of the air heat exchangers (50, 60), and the fourth port is connected to a gas line (31) of the utilization circuit (30). The four-way switching valve (16) switches between a state in which the first port and the third port communicate with each other and the second port and the fourth port communicate with each other (a first state indicated by solid curves in FIG. 3), and a state in which the first port and the fourth port communicate with each other and the second port and the third port communicate with each other (a second state indicated by broken curves in FIG. 3).

A subcooling unit (20) and a refrigerant cooling unit (25) are connected to the heat source circuit (11).

The subcooling unit (20) has a subcooling heat exchanger (21), an injection circuit (22), and a first motor-operated valve (23). The subcooling heat exchanger (21) has a first flow path (21*a*) communicating with the receiver (15), and a second flow path (21*b*) connected to the injection circuit (22). The injection circuit (22) has an inlet end connected between the receiver (15) and the subcooling unit (20), and an outlet end communicating with the suction portion of the compressor (12). The first motor-operated valve (23) is connected to the injection circuit (22) upstream of the second flow path (21*b*). The first motor-operated valve (23) is an electronic expansion valve whose opening degree is variable. In the subcooling heat exchanger (21), a liquid refrigerant flowing through the first flow path (21*a*) and a refrigerant flowing through the second flow path (21*b*) exchange heat. As a result, the liquid refrigerant flowing through the first flow path (21*a*) is cooled in the subcooling heat exchanger (21).

The refrigerant cooling unit (25) has a cooling circuit (26) and a heat transfer member (27). One end of the cooling circuit (26) is branched into two. One of the two branches of the cooling circuit (26) is connected to the first parallel circuit (18) between the first air heat exchanger (50) and the first expansion valve (13). The other of the two branches of the cooling circuit (26) is connected to the second parallel circuit (19) between the second air heat exchanger (60) and the second expansion valve (14). The other end of the cooling circuit (26) is connected between the receiver (15) and the two expansion valves (13, 14). A second motor-operated valve (28), which is an electronic expansion valve, for example, is connected to the cooling circuit (26).

The heat transfer member (27) is made of, for example, a material having a high thermal conductivity such as flat plate-shaped aluminum. A heat transfer tube constituting the cooling circuit (26) is in thermal contact with one of the surfaces of the heat transfer member (27). An electric component (81*a*) (e.g., an inverter board including a switching element) is in thermal contact with the other surface of the heat transfer member (27). Thus, the refrigerant in the refrigerant cooling unit (25) is used to cool the electric component (81*a*).

Various sensors are provided for each heat source circuit (11). Specifically, a first refrigerant temperature sensor (29*a*) is connected to the gas-side end of the first air heat exchanger (50). A second refrigerant temperature sensor (29*b*) is connected to the gas-side end of the second air heat exchanger (60). A suction pressure sensor (29*c*) is connected to the suction portion of the compressor (12). The first refrigerant temperature sensor (29*a*) detects the temperature of the refrigerant that has flowed out of the first air heat exchanger (50) serving as an evaporator. The second refrigerant temperature sensor (29*b*) detects the temperature of the refrigerant that has flowed out of the second air heat exchanger (60) serving as an evaporator. The suction pressure sensor (29*c*) detects the pressure of the refrigerant (low pressure refrigerant) sucked into the compressor (12).

[Utilization Circuit]

Each utilization circuit (30) is connected between an associated one of the heat source units (5A, 5B, 5C, 5D) and an associated one of the water heat exchangers (35, 36). Specifically, the utilization circuit (30) corresponding to the first heat source unit (5A) is connected to a first refrigerant-side flow path (35*a*) of the first water heat exchanger (35). The utilization circuit (30) corresponding to the second heat source unit (5B) is connected to a second refrigerant-side flow path (35*b*) of the first water heat exchanger (35). The utilization circuit (30) corresponding to the third heat source unit (5C) is connected to a third refrigerant-side flow path (36*a*) of the second water heat exchanger (36). The utilization circuit (30) corresponding to the fourth heat source unit (5D) is connected to a fourth refrigerant-side flow path (36*b*) of the second water heat exchanger (36).

Each of the utilization circuits (30) has a gas line (31) and a liquid line (32). The gas line (31) is connected between the gas-side end of the water heat exchanger (35, 36) and the fourth port of the four-way switching valve (16). The liquid line (32) is connected between the liquid-side end of the water heat exchanger (35, 36) and the subcooling heat exchanger (21). A third expansion valve (33), which is an electronic expansion valve, for example, is connected to the liquid line (32).

<Water Circuit>

The water circuit (40) has an inflow pipe (41), a relay pipe (42), and an outflow pipe (43) arranged in this order from the upstream side toward the downstream side. The inflow pipe (41) is connected to an inlet end of a first water flow path (35*c*) of the first water heat exchanger (35). The relay pipe (42) is connected between the first water flow path (35*c*) of the first water heat exchanger (35) and a second water flow path (36*c*) of the second water heat exchanger (36). The outflow pipe (43) is connected to an outlet end of the second water flow path (36*c*) of the second water heat exchanger (36). A water pump (44) for transporting water in the water circuit (40) is connected to the inflow pipe (41).

<Control Unit>

The chiller apparatus (1) has a control unit (81*b*) for controlling each component of the refrigerant circuit (10). The control unit (81*b*) has, for example, a microcomputer and a memory, and controls the opening degrees of the first expansion valve (13) and the second expansion valve (14). Specifically, in a heating operation described later, the control unit (81*b*) controls the opening degree of the first expansion valve (13) so that an index indicating the degree of superheat of the refrigerant flowing out of the first air heat exchanger (50) approaches a target value. Further, in the heating operation, the control unit (81*b*) controls the opening degree of the second expansion valve (14) so that an index indicating the degree of superheat of the refrigerant flowing out of the second air heat exchanger (60) approaches a target value.

—Operation of Chiller Apparatus—

A fundamental operation of the chiller apparatus (1) will be described with reference to FIG. 3. The chiller apparatus (1) switches between a cooling operation of cooling water and a heating operation of heating water.

<Cooling Operation>

In the cooling operation, a refrigeration cycle is performed in which the four-way switching valve (16) is in the first state, each of the air heat exchangers (50, 60) serves as a radiator or a condenser, and the water heat exchanger (35, 36) serves as an evaporator. Specifically, the refrigerant compressed in the compressor (12) is diverged into the first air heat exchanger (50) and the second air heat exchanger (60). In each of the air heat exchangers (50, 60), the refrigerant dissipates heat to the outdoor air to condense. The refrigerant that has dissipated heat in the first air heat exchanger (50) passes through the first expansion valve (13) which is fully opened. The refrigerant that has dissipated heat in the second air heat exchanger (60) passes through the second expansion valve (14) which is fully opened. The refrigerant merged in the receiver (15) passes through the subcooling heat exchanger (21), has its pressure reduced by the third expansion valve (33), and then flows through the water heat exchangers (35, 36). In the water heat exchangers (35, 36), the refrigerant absorbs heat from water in the water circuit (40) to evaporate, thereby cooling the water. The refrigerant evaporated in each of the water heat exchangers (35, 36) is sucked into the compressor (12) to be compressed.

<Heating Operation>

In the heating operation, a refrigeration cycle is performed in which the four-way switching valve (16) is in the second state, each of the water heat exchangers (35, 36) serves as a radiator or a condenser, and each of the air heat exchangers (50, 60) serves as an evaporator. Specifically, the refrigerant compressed in the compressor (12) flows through the water heat exchangers (35, 36). In the water heat exchangers (35, 36), the refrigerant dissipates heat to water in the water circuit (40) to condense, thereby heating the water. The refrigerant condensed in each water heat exchanger (35, 36) passes through the fully-opened third expansion valve (33), the subcooling heat exchanger (21), and the receiver (15) in this order, and is diverged into the first expansion valve (13) and the second expansion valve (14). The refrigerant that has had its pressure reduced by the first expansion valve (13) evaporates in the first air heat exchanger (50). The refrigerant that has had its pressure reduced by the second expansion valve (14) evaporates in the second air heat exchanger (60). The refrigerants evaporated in the air heat exchangers (50, 60) merge together, and the merged refrigerant is sucked into the compressor (12) and is compressed.

In the heating operation, the control unit (81*b*) individually regulates the opening degree of the first expansion valve (13) and the opening degree of the second expansion valve (14). Specifically, the opening degree of the first expansion valve (13) is regulated so that the degree of superheat of the refrigerant flowing out of the first air heat exchanger (50) reaches a predetermined value. The opening degree of the second expansion valve (14) is regulated so that the degree of superheat of the refrigerant flowing out of the second air heat exchanger (60) reaches a predetermined value. The degree of superheat of the refrigerant flowing out of the first air heat exchanger (50) is obtained, for example, from the difference between the temperature of the refrigerant detected by the first refrigerant temperature sensor (29*a*) and a saturation temperature corresponding to the pressure of the refrigerant detected by the suction pressure sensor (29*c*). Likewise, the degree of superheat of the refrigerant flowing out of the second air heat exchanger (60) is obtained, for example, from the difference between the temperature of the refrigerant detected by the second refrigerant temperature sensor (29*b*) and a saturation temperature corresponding to the pressure of the refrigerant detected by the suction pressure sensor (29*c*). Instead of directly calculating the degree of superheat, the temperature and pressure of the refrigerant can be directly used as indices of the degree of superheat.

In this way, the degree of superheat of the refrigerant flowing out of the first air heat exchanger (50) and the degree of superheat of the refrigerant flowing out of the second air heat exchanger (60) are individually controlled, so that the refrigerant can reliably evaporate to a predetermined degree of superheat in each of the air heat exchangers (50, 60). Specifically, this can reliably avoid the refrigerant from flowing out of each air heat exchanger (50, 60) in a wet state or in an excessively dried state. This can ensure a sufficient evaporation capacity of each of the air heat exchangers (50, 60). Further, this can reliably avoid the compressor (12) from sucking the liquid refrigerant.

—Configuration of Chiller Apparatus—

Next, a detailed configuration of the chiller apparatus (1) will be described with reference to FIGS. 1 to 8. In the following description, the directions "front," "rear," "right," "left," "top," and "bottom" refer to those shown in FIG. 1 as a rule.

<General Configuration>

In the chiller apparatus (1), four heat source units (5A, 5B, 5C, 5D) are arranged in a front-to-back direction. The four heat source units (5A, 5B, 5C, 5D) include a first heat source unit (5A), a second heat source unit (5B), a third heat source unit (5C), and a fourth heat source unit (5D) arranged in this order from the front side to the rear side.

Each of the heat source units (5A, 5B, 5C, 5D) has one upper casing (46) and one support part (70A, 70B, 70C, 70D). The support parts (70A, 70B, 70C, 70D) include a first support part (70A) corresponding to the first heat source unit (5A), a second support part (70B) corresponding to the second heat source unit (5B), a third support part (70C) corresponding to the third heat source unit (5C), and a fourth support part (70D) corresponding to the fourth heat source unit (5D). The support parts (70A. 70B. 70C. 70D) are connected to each other in the front-to-back direction, thereby forming an integral support (70).

The first and second air heat exchangers (50) and (60) constituting the heat exchange section (48) and intermediate frame parts (65A, 65B, 65C, 65D) respectively covering the second air heat exchangers (60) are provided between the upper casings (46) and the support parts (70A, 70B, 70C, 70D).

<Upper Casing>

The upper casings (46) are provided on top ends of the heat source units (5A, 5B, 5C, 5D). Each of the upper casings (46) is in the shape of a flat, hollow rectangular box. Each upper casing (46) houses the fan (17) (see FIG. 4). A circular air outlet (46*a*) is formed through the top of the upper casing (46) (see FIGS. 1 and 2). When the fan (17) is operated, the air flows from the outside of the two air heat exchangers (50, 60) to the inside of the two air heat exchangers (50, 60). The air flows upward through the inside of the two air heat exchangers (50, 60), and is blown upward from the air outlet (46*a*).

<First Air Heat Exchanger>

The first air heat exchanger (50) is provided for each of the heat source units (5A, 5B, 5C, 5D), or each of the support parts (70A, 70B, 70C, 70D). Each of the first air heat exchangers (50) has first to third side surfaces (51, 52, 53) through which the air passes. The first to third side surfaces (51, 52, 53) serve as a ventilation portion through which the air passes.

The first side surface (51) and the second side surface (52) are a pair of side surfaces facing each other. The first side surface (51) serves as a front surface of the first air heat exchanger (50), and the second side surface (52) serves as a rear surface of the first air heat exchanger (50). The third side surface (53) is a center side surface continuously extending between the first and second side surfaces (51) and (52), and serves as a left side surface of the first air heat exchanger (50). The four first air heat exchangers (50) are arranged adjacent to each other such that the third side surfaces (53) are aligned in a horizontal direction (front-to-back direction).

Figure 5:
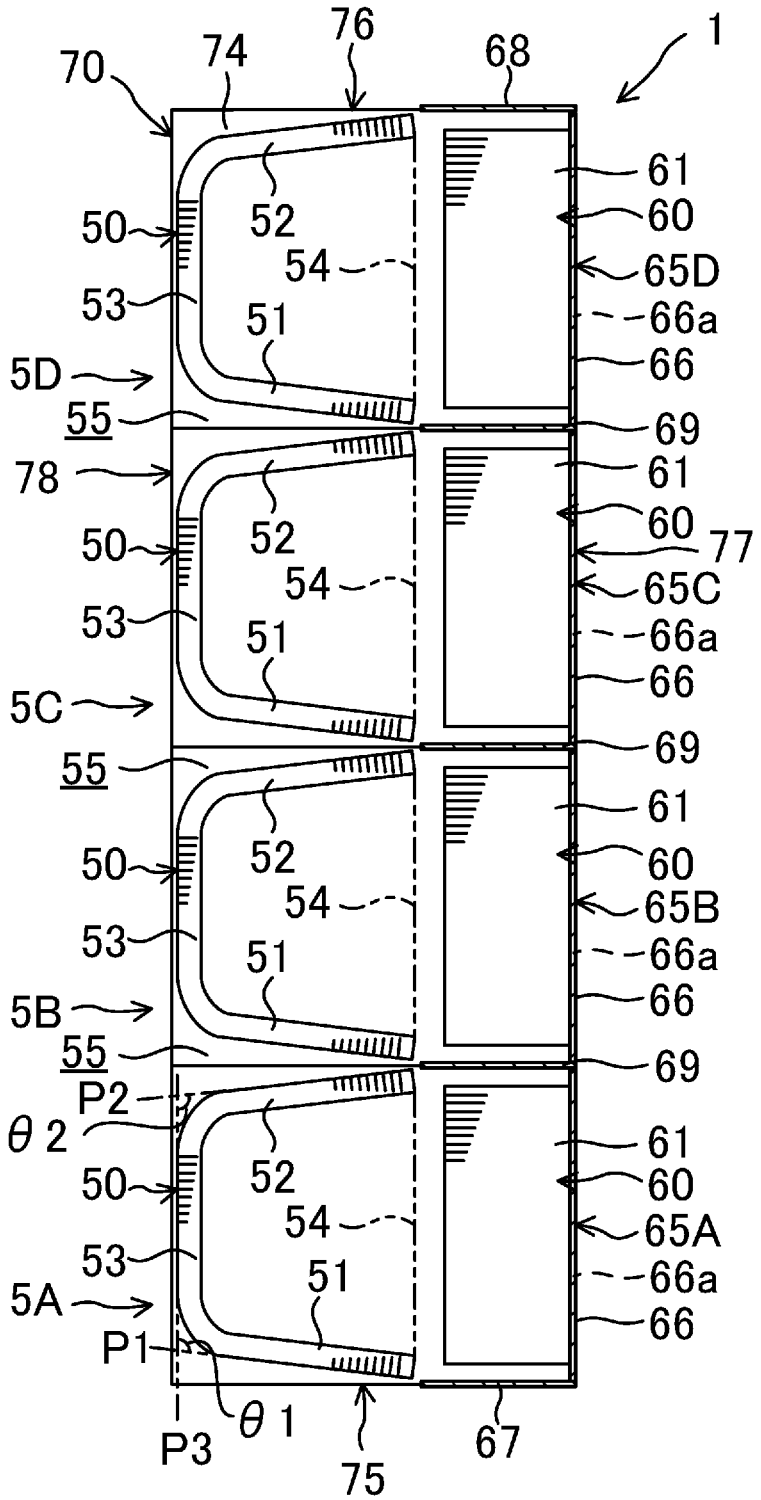
FIG. 5 is a cross-sectional view taken along line V-V of FIG. 4.

As shown in FIG. 5, each of the first air heat exchangers (50) is configured such that the side surfaces (51, 52, 53) are arranged in a substantially U shape when viewed in plan. The first air heat exchanger (50) has an open surface (54) where the side surfaces (51, 52, 53) are not provided. The first air heat exchanger (50) is a vertical air heat exchanger whose side surfaces (51, 52, 53) stand upright. No other member is provided around the side surfaces (51, 52, 53) of the first air heat exchanger (50). Thus, when the fan (17) is operated, the air around the first air heat exchanger (50) passes through the side surfaces (51, 52, 53) to flow into the first air heat exchanger (50).

In the first air heat exchanger (50), the first side surface (51) and the second side surface (52) are arranged substantially in the shape of V when viewed in plan. That is, the first side surface (51) and the second side surface (52) are in a reverse tapered arrangement such that a distance therebetween increases toward their lateral ends. In other words, the first side surface (51) and the second side surface (52) are inclined outward (front-to-hack direction) so as to form an obtuse angle with the third side surface (53). That is, as shown in FIG. 5, in the first air heat exchanger (50), a virtual plane P1 extending along the first side surface (51) and a virtual plane P3 extending along the third side surface (53) form an angle θ1 which is larger than 90 degrees. Further, in the first air heat exchanger (50), a virtual plane P2 extending along the second side surface (52) and the virtual plane P3 extending along the third side surface (53) form an angle θ2 which is larger than 90 degrees.

As shown in FIG. 5, a circulation space (55) through which the air can flow is formed between a pair of first air heat exchangers (50) adjacent to each other in the front-rear direction. The circulation space (55) is widened toward the third side surface (53) when viewed in plan. The circulation space (55) with a widened opening allows the air to easily flow into the circulation space (55).

<Second Air Heat Exchanger>

Figure 4:
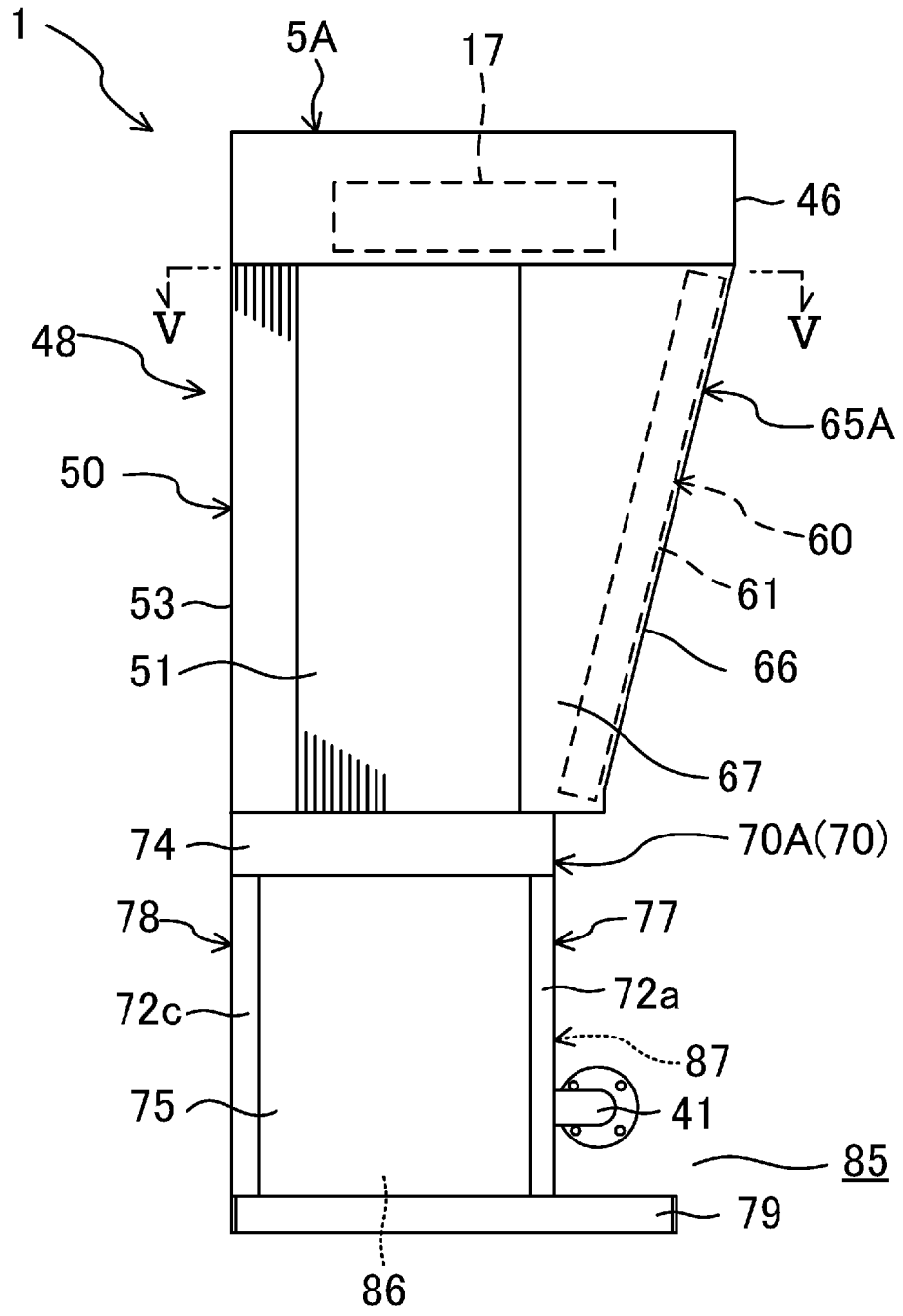
FIG. 4 is a front view of the chiller apparatus.

As shown in FIGS. 4 and 5, the second air heat exchanger (60) is arranged to oppose to the open surface (54) on the right side of the first air heat exchanger (50). The second air heat exchanger (60) is substantially in the shape of a flat plate as a whole. The second air heat exchanger (60) has a sloping surface (61) which is substantially flat and inclined in the right-to-left direction on the whole area thereof. The second air heat exchanger (60) or the sloping surface (61) is inclined to be away from the open surface (54) of the first air heat exchanger (50) toward a top end thereof.

The top end of the second air heat exchanger (60) is substantially at the same height as a top end of the first air heat exchanger (50). A bottom end of the second air heat exchanger (60) is substantially at the same height as a bottom end of the first air heat exchanger (50). The second air heat exchanger (60) is arranged to cover the entire open surface (54) of the first air heat exchanger (50).

<Number of Refrigerant Flow Paths (C) of First Air Heat Exchanger (50) and Second Air Heat Exchanger (60)>

Figure 6:
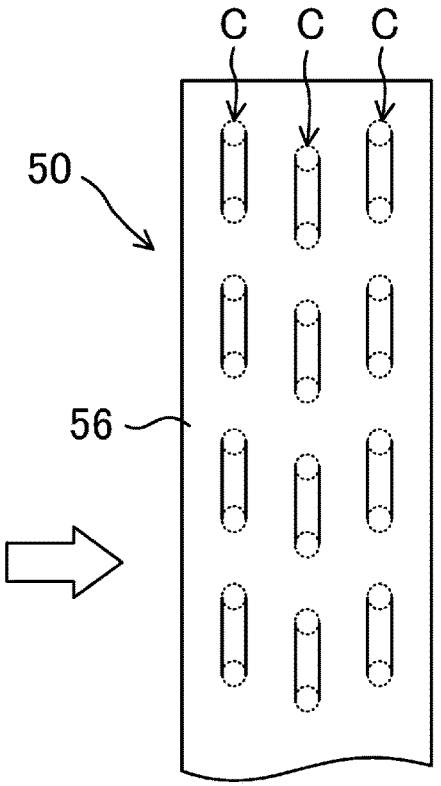
FIG. 6 is a schematic view illustrating a portion of a side of a first air heat exchanger in an enlarged scale.
Figure 7:
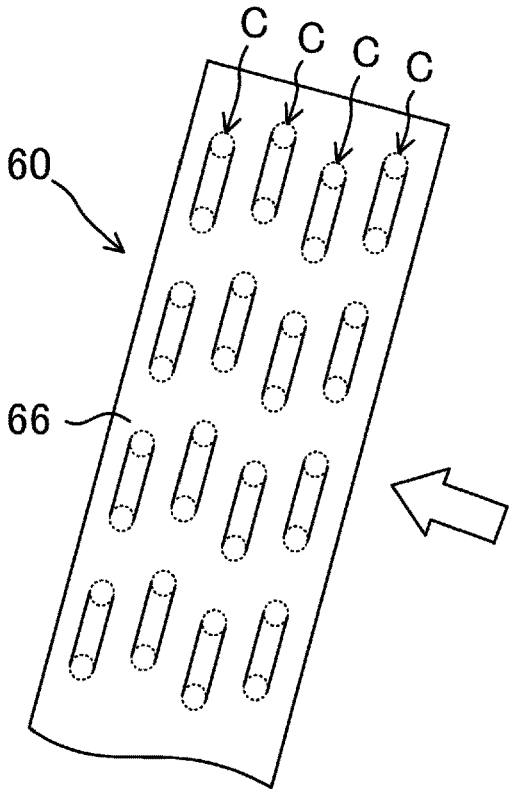
FIG. 7 is a schematic view illustrating a portion of a side of a second air heat exchanger in an enlarged scale.

As shown in FIG. 6, in the first air heat exchanger (50), the number (path number) of the refrigerant flow paths (C) arranged in a direction of air passage (the width direction of a first fin (56)) is three. On the other hand, as shown in FIG. 7, in the second air heat exchanger (60), the number (path number) of refrigerant flow paths (C) arranged in the air passage direction (the width direction of a second fin (62)) is four. That is, the second air heat exchanger (60) includes a larger number of refrigerant flow paths (C) than the first air heat exchanger (50). In this embodiment, the first fin (56) of the first air heat exchanger (50) has approximately the same width as the second fin (62) of the second air heat exchanger (60).

As shown in FIG. 4, the second air heat exchanger (60) is obliquely arranged so that its outflow surface faces the fan (17). As compared with the case where the second air heat exchanger (60) is placed upright, the outflow surface of the second air heat exchanger (60) according to this embodiment is located closer to the fan (17), so that the air can flow more smoothly. This means that the second air heat exchanger (60) arranged obliquely can reduce a resistance of a flow path between the second air heat exchanger (60) and the fan (17). Accordingly, when the second air heat exchanger (60) is provided with a larger number of refrigerant flow paths (C) than the first air heat exchanger (50), the total heat transfer area of the second air heat exchanger (60)

can be increased while sufficiently ensuring the air flow volume of the second air heat exchanger (60).

Note that the second air heat exchanger (60) may have the same number of (e.g., three) refrigerant flow paths (C) as the first air heat exchanger (50).

<Intermediate Frame Part>

As shown in FIG. 5 and other drawings, the four intermediate frame parts (65A, 65B, 65C, 65D) include a first intermediate frame part (65A) corresponding to the first heat source unit (5A), a second intermediate frame part (65B) corresponding to the second heat source unit (5B), a third intermediate frame part (65C) corresponding to the third heat source unit (5C), and a fourth intermediate frame part (65D) corresponding to the fourth heat source unit (5D). The intermediate frame parts (65A, 65B, 65C, 65D) are disposed to cover the second air heat exchangers (60). The four intermediate frame parts (65A, 65B, 65C, 65D) each have a frame plate (66) which is inclined along the second air heat exchanger (60). The frame plate (66) is formed in a frame shape covering the second air heat exchanger (60) from outside, and has a vent (66*a*) formed in an inner portion thereof (see FIG. 1). Specifically, the sloping surface (61) of the second air heat exchanger (60) is exposed outside through the vent (66*a*) of the frame plate (66).

As shown in FIGS. 1 and 5 and other drawings, a first shielding plate (67) is formed on the front side of the first intermediate frame part (65A). The first shielding plate (67) extends from the front end of the frame plate (66) of the first intermediate frame part (65A) to the vicinity of the end of the first side surface (51) of the first air heat exchanger (50). The first shielding plate (67) blocks the air from flowing out of a space between the first side surface (51) of the first air heat exchanger (50) and the second air heat exchanger (60). The first shielding plate (67) is in the shape of an inverted trapezoid or a right-angled triangle whose width is narrowed downward.

As shown in FIG. 5, a second shielding plate (68) having substantially the same shape as the first shielding plate (67) is formed on the back side of the fourth intermediate frame part (65D). The second shielding plate (68) extends from the rear end of the frame plate (66) of the fourth intermediate frame part (65D) to the vicinity of the end of the second side surface (52) of the first air heat exchanger (50). The second shielding plate (68) blocks the air from flowing out of a space between the second side surface (52) of the first air heat exchanger (50) and the second air heat exchanger (60). The second shielding plate (68) is in the shape of an inverted trapezoid or a right-angled triangle whose width is narrowed downward.

Between an adjacent pair of the second air heat exchangers (60), an intermediate shielding plate (69) having substantially the same shape as the first shielding plate (67) and the second shielding plate (68) is provided. In other words, the intermediate shielding plates (69) are positioned and shaped to have a plane of projection of substantially the same shape as the first shielding plate (67) and the second shielding plate (68) when viewed from the front. Each of a plurality of (three in this example) intermediate shielding plates (69) has a right end fixed to the lateral end of the adjacent frame plate (66). The left end of each intermediate shielding plate (69) is in the vicinity of the ends of a pair of the side surfaces (51, 52) of the first air heat exchangers (50) adjacent to each other. The intermediate shield plate (69) blocks the air in one of an adjacent pair of the heat source units (5A, 5B, 5C, 5D) from flowing into the other heat source unit (5A, 5B, 5C, 5D).

<Support>

The support (70) is formed in a substantially rectangular parallelepiped shape which is elongated in the front-rear direction. The support (70) has first and second side frames (71*a*, 71*b*), first to fourth vertical frames (72*a*, 72*b*, 72*c*, 72*d*), and first to sixth intermediate frames (73*a*, 73*b*, 73*c*, 73*d*, 73*e*, 73*t*).

The first side frame (71*a*) is disposed at the right end of the support (70), and the second side frame (71*b*) is disposed at the left end of the support (70). The first side frame (71*a*) and the second side frame (71*b*) are formed in a rod shape extending in the front-to-back direction to be parallel to each other.

The first vertical frame (72*a*) is fixed to a front end of the first side frame (71*a*), and the second vertical frame (72*b*) is fixed to a rear end of the first side frame (71*a*). The third vertical frame (72*c*) is fixed to a front end of the second side frame (71*b*), and the fourth vertical frame (72*d*) is fixed to a rear end of the second side frame (71*b*).

The first to third intermediate frames (73*a*, 73*b*, 73*c*) are fixed to an intermediate portion of the first side frame (71*a*), and arranged in the front-to-back direction. The fourth to sixth intermediate frames (73*d*, 73*e*, 73*f*) are fixed to an intermediate portion of the second side frame (71*b*) and arranged in the front-to-back direction. The first to sixth intermediate frames (73*a*, 73*b*, 73*c*, 73*d*, 73*e*, 730 are formed in a vertical rod shape extending upward from the intermediate portion of each of the side frames (71*a*, 71*b*), and arranged in parallel to each other.

One base (74) is provided at the top end of the support (70). The base (74) is supported by the first to fourth vertical frames (72*a*, 72*b*, 72*c*, 72*d*) and the first to sixth intermediate frames (73*a*, 73*b*, 73*c*, 73*d*, 73*e*, 73*f*). The base (74) is in the shape of a plate or a rectangular parallelepiped elongated in the front-rear direction, and extends in parallel with the side frames (71*a*, 71*b*). The two air heat exchangers (50, 60) (heat exchange section (48)) and the intermediate frame parts (65A, 65B, 65C, 65D) are disposed on a top surface of the base (74).

A front panel (75) is provided to stand upright on a front surface of the support (70). The front panel (75) is detachably attached to the first vertical frame (72*a*) and the third vertical frame (72*c*). A rear panel (76) is provided to stand upright on a rear surface of the support (70). The rear panel (76) is detachably attached to the second vertical frame (72*b*) and the fourth vertical frame (72*d*).

A first support side surface (77) is formed on the right side of the support (70). The first support side surface (77) is located below the open surfaces (54) of the first air heat exchangers (50). The first support side surface (77) includes first to fourth vertical side panels (77*a*, 77*b*, 77*c*, 77*d*). The first side panel (77*a*) is detachably attached to the first vertical frame (72*a*) and the first intermediate frame (73*a*). The second side panel (77*b*) is detachably attached to the first intermediate frame (73*a*) and the second intermediate frame (73*b*). The third side panel (77*c*) is detachably attached to the second intermediate frame (73*b*) and the third intermediate frame (73*c*). The fourth side panel (77*d*) is detachably attached to the third intermediate frame (73*c*) and the second vertical frame (72*b*).

A second support side surface (78) is formed on the left side of the support (70). The second support side surface (78) is located below the first air heat exchangers (50). The second support side surface (78) includes fifth to eighth vertical side panels (78*a*, 78*b*, 78*c*, 78*d*). The fifth side panel (78*a*) is detachably attached to the third vertical frame (72*c*) and the fourth intermediate frame (73*d*). The sixth side panel (78*b*) is detachably attached to the fourth intermediate frame (73*d*) and the fifth intermediate frame (73*e*). The seventh side panel (78*c*) is detachably attached to the fifth intermediate frame (73*e*) and the sixth intermediate frame (73*f*). The eighth side panel (78*d*) is detachably attached to the sixth intermediate frame (730 and the fourth vertical frame (72*d*).

First to fourth machine chambers (S1, S2, S3, S4) are defined between the first and second support side surfaces (77) and (78) of the support (70). The first to fourth machine chambers (S1, S2, S3, S4) are rectangular parallelepiped spaces, and arranged in a row in the front-to-back direction. Specifically, the first machine chamber (S1) is defined between the first side panel (77*a*) and the fifth side panel (78*a*), and the second machine chamber (S2) is defined between the second side panel (77*b*) and the sixth side panel (78*b*). The third machine chamber (S3) is defined between the third side panel (77*c*) and the seventh side panel (78*c*), to and the fourth machine chamber (S4) is defined between the fourth side panel (77*d*) and the eighth side panel (78*d*).

In the support (70), components defining the first machine chamber (S1) constitute the first support part (70A), components defining the second machine chamber (S2) constitute the second support part (70B), components defining the third machine chamber (S3) constitute the third support part (70C), and components defining the fourth machine chamber (S4) constitute the fourth support part (70D).

In this embodiment, for example, the first and second side frames (71*a*, 71*b*) and the base (74) are common components defining the machine chambers (S1, S2, S3, S4) of the support parts (70A, 70B, 70C, 70D). Note that the first and second side frames (71*a*, 71*b*) and the base (74) may be divided into portions respectively corresponding to the machine chambers (S1, S2, S3, S4) or the support parts (70A, 70B, 70C, 70D). In this way, each of the support parts (70A, 70B, 70C, 70D) can be independently moved (e.g., lifted) together with an associated one of the heat source units (5A, 5B, 5C, 5D).

<Leg>

As shown in FIGS. 1, 2, and 4 and other drawings, two legs (79) are provided at the bottom end of the support (70). One of the legs (79) is fixed to the bottom end of the front panel (75), and the other leg (79) is fixed to the bottom end of the rear panel (76). Each of the legs (79) extends horizontally from the bottom end of the first support side surface (77) to the right. That is, each leg (79) has a protruding portion located below the second air heat exchangers (60) or the intermediate frame parts (65A, 65B, 65C, 65D). The number of the legs (79) is not limiting, and may be three or more.

As shown in FIG. 4, the entire outer shape of the chiller apparatus (1) is formed into an inverted L shape when viewed from the front. In other words, in the chiller apparatus (1), the second air heat exchanger (60) and its peripheral components overhang outward (to the right) from the second support side surface (78). Therefore, there is a possibility that the chiller apparatus (1) falls down to the right. However, the legs (79) extend from the bottom end of the support (70) in the direction in which the second air heat exchanger (60) overhangs, so that the risk of the fall can be avoided with reliability.

<Layout of Main Components in Machine Chamber>

Figure 8:
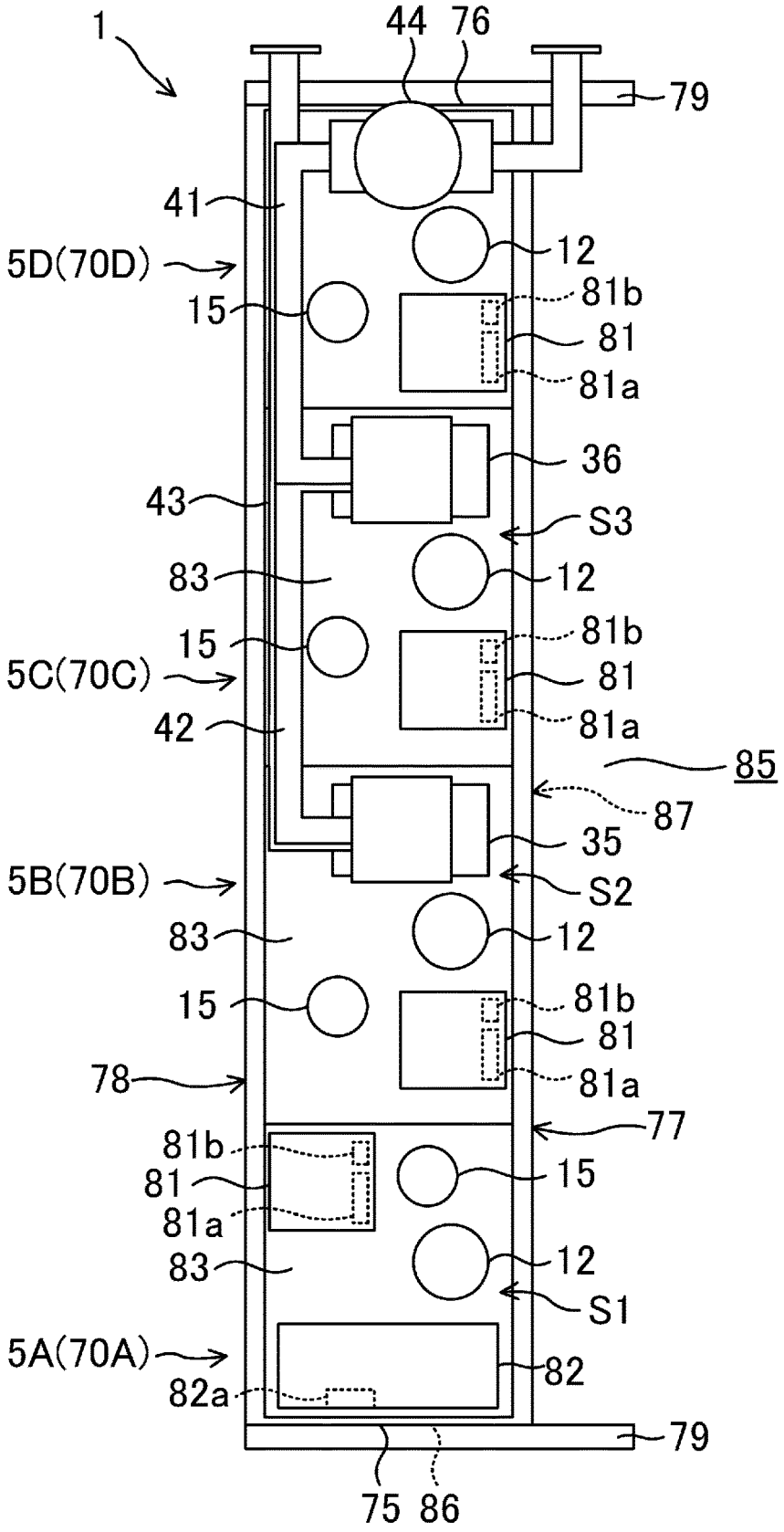
FIG. 8 is a plan view illustrating the layout of main components in a machine chamber.

Next, the layout of main components in the machine chamber (S1, S2, S3, S4) will be described with reference to FIG. 8. FIG. 8 does not show a refrigerant pipe of the refrigerant circuit (10).

[General Description of Layout]

In each machine chamber (S1, S2, S3, S4), the compressor (12), the receiver (15), and a system-side electric component box (81), one each, are installed. Each system-side electric component box (81) houses an electric component (81*a*), such as an inverter board, for supplying electric power to the corresponding compressor (12). Each machine chamber (S1, S2, S3, S4) is provided with the refrigerant cooling unit (25), (not shown in FIG. 8), for cooling the electric component (81*a*) in the system-side electric component box (81). Further, the system-side electric component box (81) houses a control unit (81*b*) for controlling the first expansion valve (13) and the second expansion valve (14) of the corresponding refrigerant circuit (10).

An operation-side electric component box (82) is installed in the first machine chamber (S1). An operation unit (82*a*) for operating the refrigeration apparatus is installed in the operation-side electric component box (82). The first water heat exchanger (35) is installed in the second machine chamber (S2). The second water heat exchanger (36) is installed in the third machine chamber (S3). The water pump (44) is installed in the fourth machine chamber (S4).

[Withdrawable Bottom Plate]

A withdrawable bottom plate (83) is provided for each machine chamber (S1, S2. S3, S4). The withdrawable bottom plate (83) is in the form of a rectangle which is slightly elongated in the front-rear direction, and constitutes the bottom of the corresponding machine chamber (S1, S2, S3, S4). The withdrawable bottom plate (83) is mounted on the support (70) to be slidable toward a maintenance space (85) formed on the right side of the support (70).

[First Machine Chamber]

In the first machine chamber (S1), the compressor (12), the receiver (15), the system-side electric component box (81), and the operation-side electric component box (82) are installed. The compressor (12) is arranged at a center portion of the first machine chamber (S1) in the front-to-back direction near the first support side surface (77) (near the maintenance space (85)). In the first machine chamber (S1), the operation-side electric component box (82) is arranged on the front side of the compressor (12) (toward the front panel (75)). In the first machine chamber (S1), the receiver (15) is arranged on the back side of the compressor (12) (toward the rear surface panel (76) or the fourth machine chamber (S4)). In the first machine chamber (S1), the system-side electric component box (81) is arranged on the left side of the receiver (15).

[Second Machine Chamber]

In the second machine chamber (S2), the compressor (12), the receiver (15), the system-side electric component box (81), and the first water heat exchanger (35) are installed. The system-side electric component box (81), the compressor (12), and the first water heat exchanger (35) are arranged in this order from the front side to the rear side of the second machine chamber (S2) near the first support side surface (77). In other words, in the second machine chamber (S2), the compressor (12) is arranged between the system-side electric component box (81) and the first water heat exchanger (35). In the second machine chamber (S2), a portion of the relay pipe (42) and a portion of the outflow pipe (43) are arranged. The relay pipe (42) and the outflow pipe (43) are arranged near the second support side surface (78) of the second machine chamber (S2).

[Third Machine Chamber]

In the third machine chamber (S3), the compressor (12), the receiver (15), the system-side electric component box (81), and the second water heat exchanger (36) are installed.

The system-side electric component box (81), the compressor (12), and the second water heat exchanger (36) are arranged in this order from the front side to the rear side of the third machine chamber (S3) near the first support side surface (77). In other words, in the third machine chamber (S3), the compressor (12) is arranged between the system-side electric component box (81) and the second water heat exchanger (36). In the third machine chamber (S3), a portion of the inflow pipe (41), a portion of the relay pipe (42), and a portion of the outflow pipe (43) are arranged. The inflow pipe (41), the relay pipe (42), and the outflow pipe (43) are arranged near the second support side surface (78) of the third machine chamber (S3). In the third machine chamber (S3), the receiver (15) is arranged between the relay and outflow pipes (42, 43) and the system-side electric component box (81).

[Fourth Machine Chamber]

In the fourth machine chamber (S4), the compressor (12), the receiver (15), the system-side electric component box (81), and the water pump (44) are installed. The system-side electric component box (81), the compressor (12), and the water pump (44) are arranged in this order from the front side to the rear side of the fourth machine chamber (S4) near the first support side surface (77). In other words, in the fourth machine chamber (S4), the compressor (12) is arranged between the system-side electric component box (81) and the water pump (44). In the fourth machine chamber (S4), a portion of the inflow pipe (41) and a portion of the outflow pipe (43) are arranged. The inflow pipe (41) and the outflow pipe (43) are arranged near the second support side surface (78) of the fourth machine chamber (S4). In the fourth machine chamber (S4), the receiver (15) is arranged between the inflow and outflow pipes (41, 43) and the system-side electric component box (81). An inlet portion of the inflow pipe (41) extends from the fourth machine chamber (S4) to the outside through the second support side surface (fourth side panel (77*d*)). An outlet portion of the outflow pipe (43) extends from the fourth machine chamber (S4) to the outside through the rear panel (76).

<Structure for Maintenance>

As shown in FIG. 8, the front panel (75) and the first support side surface (77) of the chiller apparatus (1) constitute a main maintenance surface. When the front panel (75) is removed, the operation-side electric component box (82) is exposed to the outside through a front maintenance port (86). This makes the operation-side electric component box (82) easily accessible. When the first to fourth side panels (77*a*, 77*b*, 77*c*, 77*d*) constituting the first support side surface (77) are removed, the compressors (12) in the machine chambers (S1, S2, S3, S4) and the system-side electric component boxes (81) in the second to fourth machine chambers (S2, S3, S4) are exposed to the outside through a side maintenance port (87). This makes the compressors (12) in the machine chambers (S1, S2, S3, S4) and the system-side electric component boxes (81) in the second to fourth machine chambers (S2, S3, S4) easily accessible. Note that the system-side electric component box (81) in the first machine chamber (S1) is accessible when the fifth side panel (78*a*) is removed (see FIG. 2).

When the first to fourth side panels (77*a*, 77*b*, 77*c*, 77*d*) are removed (see FIG. 1), each of the withdrawable bottom plates (83) can be withdrawn toward the maintenance space (85). Thus, work can be performed after the compressors (12) and other components are withdrawn to the maintenance space (85).

Figure 9:
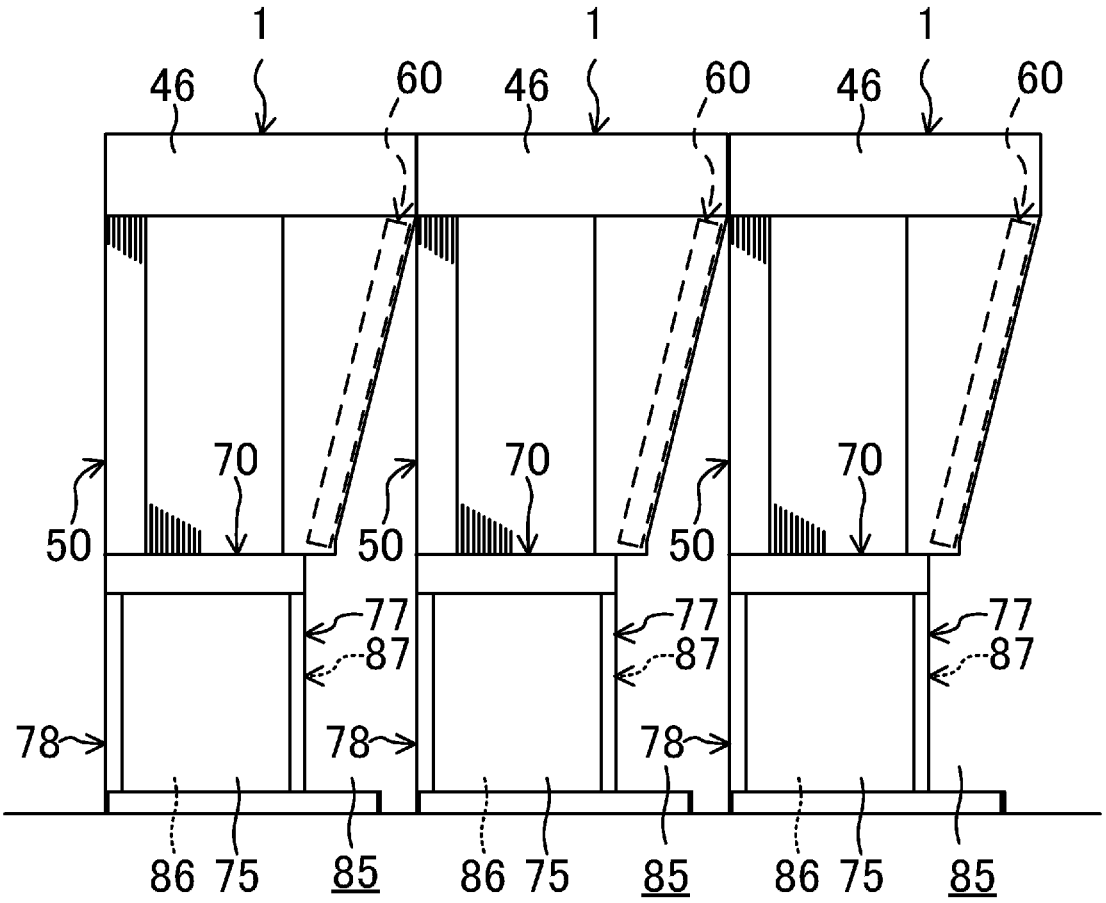
FIG. 9 is a front view illustrating a plurality of chiller apparatuses arranged in a horizontal direction.

As shown in FIG. 9, a plurality of chiller apparatuses (1) may be arranged in the right-to-left direction. In this case, the chiller apparatuses (1) are arranged such that the first support side surface (77) of one of an adjacent pair of the chiller apparatuses (1) faces the second support side surface (78) of the other chiller apparatus (1). In this state, a relatively wide maintenance space (85) can be formed between the adjacent supports (70) below the second air heat exchanger (60). This makes it possible to perform the maintenance of the components while reducing the distance between the plurality of chiller apparatuses (1).

Advantages of Embodiment

In this embodiment, as shown in FIG. 4, the first air heat exchanger (50) having the three side surfaces (51, 52, 53) is placed upright, and the second air heat exchanger (60) having a planar shape is arranged obliquely to cover the open surface (54) of the first air heat exchanger (50). Thus, the pair of side surfaces (51,52) of the first air heat exchanger (50) can extend to the vicinity of the bottom end of the second air heat exchanger (60), and the area of the shielding plate (67) between the two air heat exchangers (50, 60) can be made relatively small. Accordingly, compared with the configuration of the prior art, the total heat transfer area of the heat exchange section (48) per installation space can be increased, which can improve the cooling capacity and heating capacity of the refrigeration apparatus (1). Moreover, since the second air heat exchanger (60) has a simple flat plate shape which does not require the bending of the heat transfer tube, the cost of the heat exchange section (48) can be reduced.

In this embodiment, the maintenance space (85) can be formed below the second air heat exchanger (60), through which access to the machine chamber (S1, S2, S3, S4) is allowed. In this case, even when a plurality of refrigeration apparatuses (1) is arranged in the horizontal direction as shown in FIG. 9, the maintenance space (85) can be formed between the refrigeration apparatuses (1) adjacent to each other.

In this embodiment, the legs (79) extending, in the direction in which the second air heat exchanger (60) overhangs are provided at the bottom of the support (70). This can reliably avoid the refrigeration apparatus (1) from falling down.

The second air heat exchanger (60) of this embodiment is arranged obliquely so that its outflow surface faces the fan (17). This can reduce the resistance of the flow path from the second air heat exchanger (60) to the fan (17). Accordingly, the second air heat exchanger (60) is provided with a larger number of refrigerant flow paths (C) than the first air heat exchanger (50). This can further enlarge the heat transfer area of the second air heat exchanger (60) while keeping a sufficient air volume in the second air heat exchanger (60).

In the first air heat exchanger (50) of this embodiment, the two side surfaces (51, 52) facing each other are arranged obliquely as shown in FIG. 5, which can further increase the heat transfer area of the side surfaces (51, 52). In addition, the circulation space (55) which is widened toward the base of the two side surfaces (51, 52) is formed between the two adjacent side surfaces (51, 52). Therefore, the air outside the first air heat exchanger (50) can be introduced deep inside the circulation space (55), and the heat transfer area of each side surface (51, 52, 53) can be effectively utilized.

Other Embodiments

In the above embodiment, both of the side surfaces (51, 52) of the first air heat exchanger (50) facing each other are arranged obliquely. However, only one of the side surfaces (51, 52) may be arranged obliquely, and the other may be arranged at right angles to the center side surface (53), or both of the side surfaces (51, 52) may be arranged at right angles to the center side surface (53).

INDUSTRIAL APPLICABILITY

As can be seen, the present invention is useful for a refrigeration apparatus.

DESCRIPTION OF REFERENCE CHARACTERS

1 Refrigeration Apparatus
10 Refrigerant Circuit
13 First Expansion Valve
14 Second Expansion Valve
17 Fan
48 Heat Exchange Section
50 First Air Heat Exchanger
51 First Side Surface
52 Second Side Surface
53 Third Side Surface
54 Open Surface
55 Circulation Space (Space)
60 Second Air Heat Exchanger
61 Sloping Surface
70 Support
77 First Support Side Surface (Side Surface)
79 Leg
S1 First Machine Chamber
S2 Second Machine Chamber
S3 Third Machine Chamber
S4 Fourth Machine Chamber

The invention claimed is:

1. A refrigeration apparatus comprising: a heat exchange section allowing a refrigerant and air to exchange heat; a fan transporting the air passing through the heat exchange section; and a support supporting the heat exchange section from below, wherein the heat exchange section includes a first air heat exchanger having three vertical side surfaces through which the air passes, the three side surfaces being arranged in a U shape when viewed in plan, and a second air heat exchanger which is formed in a flat plate shape, arranged obliquely to be away from an open surface of the first air heat exchanger toward a top end thereof, and has a single sloping surface through which the air passes, wherein machine chambers are formed in the support, the second air heat exchanger is incline so as to overhang outward from a side surface of the support, and a frame plate is inclined along the second air heat exchanger and has a vent for exposing the second air heat exchanger outward.

2. The refrigeration apparatus of claim 1, wherein a leg protruding in a direction in which the second air heat exchanger overhangs is provided at a bottom of the support.

3. The refrigeration apparatus of claim 1, further comprising:

a refrigerant circuit in which the first air heat exchanger, the second air heat exchanger, a first expansion valve, and a second expansion valve are connected in parallel, the first and second expansion valves respectively corresponding to the first and second air heat exchangers, wherein in an operation in which the first and second air heat exchangers serve as evaporators, opening degrees of the first and second expansion valves are individually controlled so that an index indicating a degree of superheat of the refrigerant flowing out of the first air heat exchanger approaches a target value, and an index indicating a degree of superheat of the refrigerant flowing out of the second air heat exchanger approaches a target value.

4. The refrigeration apparatus of claim 1, wherein at least one of a pair of side surfaces of the first air heat exchanger facing each other is inclined outward to form an obtuse angle with a center side surface.

5. The refrigeration apparatus of claim 4, wherein the heat exchange section includes a plurality of heat exchange sections comprising a plurality of first air heat exchangers and a plurality of second air heat exchangers, the plurality of heat exchange sections are arranged adjacent to each other such that the center side surfaces of the first air heat exchangers in the plurality of heat exchange sections are aligned in a horizontal direction, the at least one of a pair of side surfaces of the first air heat exchanger comprising both of the pair of side surfaces inclined outward so as to form an obtuse angle with the center side surface, and a space which is widened toward the center side surface is formed between the two side surfaces adjacent to each other.

6. The refrigeration apparatus of claim 2, further comprising:

a refrigerant circuit in which the first air heat exchanger, the second air heat exchanger, a first expansion valve, and a second expansion valve are connected in parallel, the first and second expansion valves respectively corresponding to the first and second air heat exchangers, wherein in an operation in which the first and second air heat exchangers serve as evaporators, opening degrees of the first and second expansion valves are individually controlled so that an index indicating a degree of superheat of the refrigerant flowing out of the first air heat exchanger approaches a target value, and an index indicating a degree of superheat of the refrigerant flowing out of the second air heat exchanger approaches a target value.

7. The refrigeration apparatus of claim 1, wherein at least one of a pair of side surfaces of the first air heat exchanger facing each other is inclined outward to form an obtuse angle with a center side surface.

8. The refrigeration apparatus of claim 2, wherein at least one of a pair of side surfaces of the first air heat exchanger facing each other is inclined outward to form an obtuse angle with a center side surface.

9. The refrigeration apparatus of claim 3, wherein at least one of a pair of side surfaces of the first air heat exchanger facing each other is inclined outward to form an obtuse angle with a center side surface.

* * * * *